US010428598B2

(12) United States Patent
Wright

(10) Patent No.: US 10,428,598 B2
(45) Date of Patent: Oct. 1, 2019

(54) WELLHEAD MIXING DEVICE

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 0 days.

(21) Appl. No.: 15/435,043

(22) Filed: Feb. 16, 2017

(65) Prior Publication Data

US 2017/0234097 A1 Aug. 17, 2017

Related U.S. Application Data

(60) Provisional application No. 62/295,955, filed on Feb. 16, 2016.

(51) Int. Cl.
*E21B 17/22* (2006.01)
*E21B 33/03* (2006.01)

(52) U.S. Cl.
CPC ..... *E21B 17/22* (2013.01); *E21B 33/03* (2013.01)

(58) Field of Classification Search
CPC ..... E21B 33/068; E21B 43/26; E21B 17/22; E21B 33/03
See application file for complete search history.

(56) References Cited

U.S. PATENT DOCUMENTS 4,169,504 A * 10/1979 Scott ..... E21B 33/068 166/90.1
6,575,247 B2 * 6/2003 Tolman ..... E21B 33/068 166/305.1
6,899,172 B2 * 5/2005 McLeod ..... E21B 33/068 166/90.1
7,478,673 B2 * 1/2009 Boyd ..... E21B 33/068 166/177.5
7,703,535 B2 * 4/2010 Benson ..... E21B 17/01 141/82
7,789,133 B2 * 9/2010 McGuire ..... E21B 43/26 166/177.5
8,770,277 B2 * 7/2014 Artherholt ..... E21B 43/26 166/177.5
8,820,400 B2 * 9/2014 McGuire ..... E21B 43/26 166/177.5
8,936,094 B2 * 1/2015 Least ..... E21B 34/06 166/205
2016/0060997 A1 * 3/2016 Thomas ..... E21B 33/068 166/88.4
2017/0002620 A1 * 1/2017 Roesner ..... E21B 33/068

* cited by examiner

*Primary Examiner* — Matthew R Buck

(57) ABSTRACT

A wellhead capable of steering fluid flow to minimize contact with equipment in the wellbore comprises a central bore and a plurality of side bores coupled to injection ports. The plurality of side bores comprise a rifled internal surface having a circular or helical configuration into which fluids can be injected. The side bores intersect with the central bore at a mixing chamber, which also comprises a rifled internal surface. By injecting fluids into the wellbore through these ports, the operator can create a vortex utilizing the full capacity of the wellhead while minimizing contact with any wireline equipment.

11 Claims, 3 Drawing Sheets

WELLHEAD MIXING DEVICE

PRIORITY STATEMENT

This is a non-provisional application claiming priority to U.S. Provisional Application No. 62/295,955, filed Feb. 16, 2016 and entitled "Wellhead Mixing Device." The contents of this provisional application are incorporated herein by reference.

FIELD OF THE APPLICATION

The application relates generally to a wellhead for introducing and promoting a circular or helical fluid flow to fluid introduced through various injection ports.

BACKGROUND

Often, fluids injected into a wellbore may be reactive, corrosive, or otherwise damaging to wireline equipment. Alternatively, operations may necessitate wireline equipment being withdrawn simultaneously to the injection of fluid into the wellbore, which would mean the wireline equipment would face increased resistance in the form of counter-directional fluid flow. In both instances, creating a circular or helical fluid flow therefore minimizes the impact of these fluids on the equipment.

Prior art wellheads, such as U.S. Pat. No. 6,575,247 to Tolman and U.S. Pat. No. 7,478,673 to Boyd, have attempted to introduce this flow pattern through use of angled injection ports and funneled mixing chambers to create a drain vortex. However, both of these methods reduce the overall capacity of the wellhead for fluid flow.

A need therefore exists for a wellhead which can create a circular or helical fluid flow for larger amounts of fluid, for instance, as used in fracking-type operations. Embodiments disclosed in the present application meet this need.

DRAWINGS

DESCRIPTION OF THE INVENTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Embodiments of the present invention include an apparatus and methods for utilizing a wellhead having both a central bore, which can be suitable for wireline equipment operations, and a plurality of rifled internal bores with peripheral injection ports, which can be suitable for injecting fluid into the central bore. Significantly, the rifled internal bores can comprise a rifled internal surface that is designed to create circular or helical fluid flow for fluids being injected into the wellbore.

As shown in the Figures, the wellhead features a mixing chamber that can be located beneath the peripheral injection ports, which can comprise the rifled internal surface that is designed to maintain the circular or helical fluid flow, while also blending the fluids from the plurality of peripheral injection ports. The mixing chamber can be located above and fluidly connected to the wellbore.

Figure 1A:
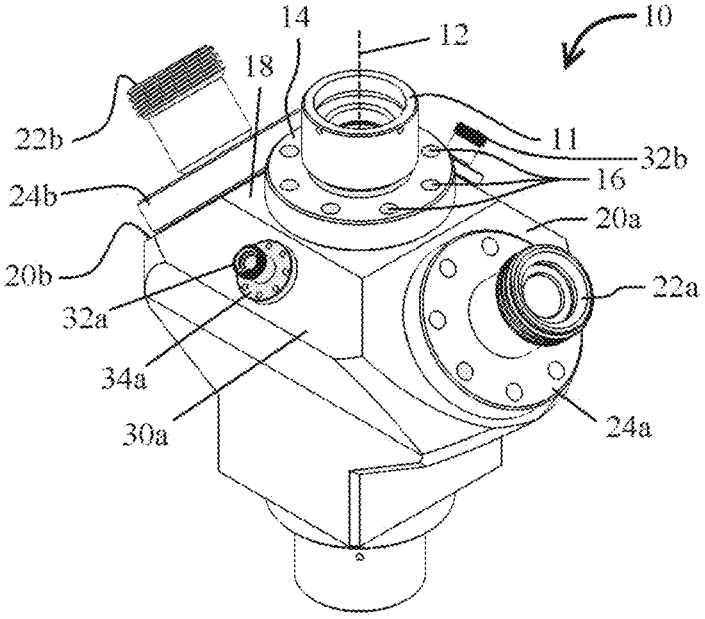
FIG. 1A depicts a perspective view of an embodiment of the wellhead.

Turning now to FIG. 1A, the Figure depicts an external perspective view of an embodiment of the wellhead 10, featuring a central bore 12 that can be fastened with a flange 14, which, as shown, features a plurality of attachment points 16 for fastening the flange 14 to the top surface 18 of the wellhead 10. In other embodiments, the flange 14 can be attached to the wellhead 10 by any number or any type of attachments (e.g., fasteners). The central bore 12 and the flange 14 are shown in this embodiment with a generic tubular 11 through which wireline operations can be conducted and various mechanical tools passed.

Figure 1B:
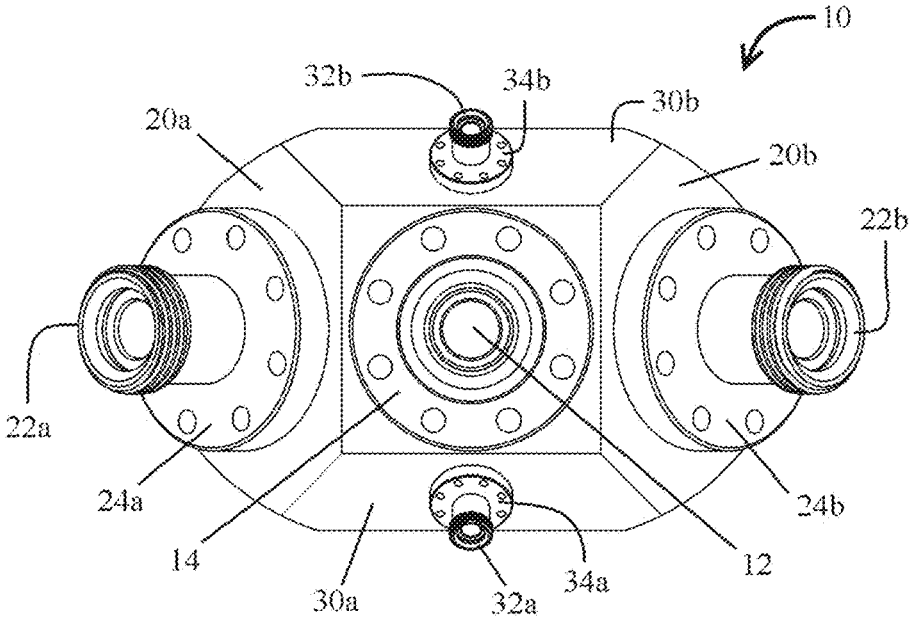
FIG. 1B depicts a top (plan) view of an embodiment of the wellhead.

The wellhead 10, as shown in FIG. 1A, can include two primary angled surfaces 20*a*, 20*b* and two secondary angled surfaces 30*a*, 30*b* (shown in FIG. 1B). Each of these angled surfaces 20*a*, 20*b*, 30*a*, 30*b* can comprise a flange 24*a*, 24*b*, 34*a*, 34*b* (shown in FIG. 1B), wherein each flange can comprise a plurality of attachment points for securing a respective peripheral injection port 22*a*, 22*b*, 32*a*, 32*b*. In the depicted embodiment, primary peripheral injection ports 22*a*, 22*b* are shown as substantially larger than secondary peripheral injection ports 32*a*, 32*b*. However, it can be appreciated by those of skill in the art that this is only one possible configuration of the wellhead, and alternative embodiments may comprise four equally spaced and sized injection ports, or injection ports of four varying sizes, as required by the job.

Figure 1C:
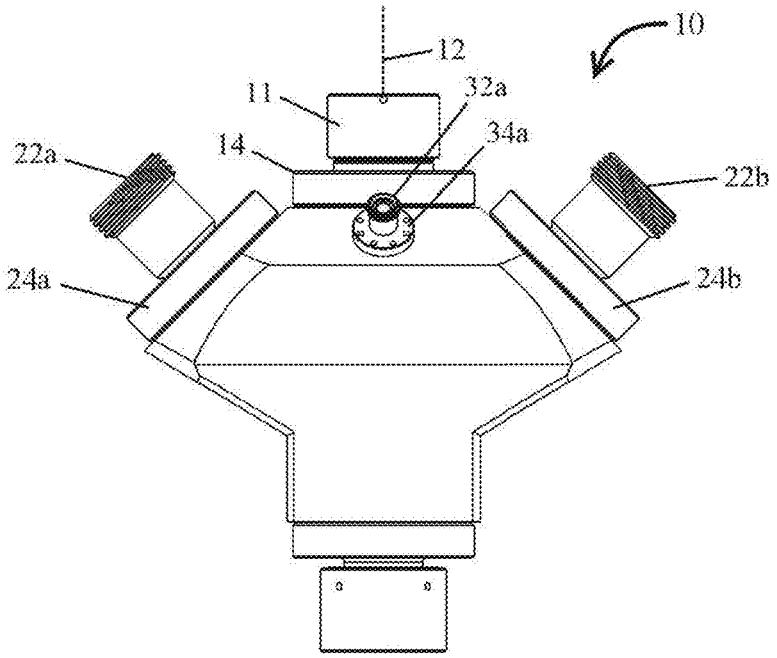
FIG. 1C depicts a front view of an embodiment of the wellhead.
Figure 1D:
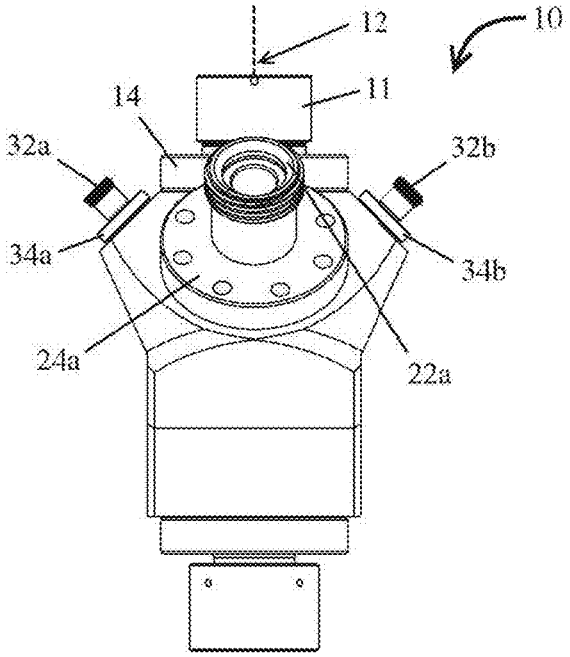
FIG. 1D depicts a side view of an embodiment of the wellhead.

FIGS. 1B, 1C, and 1D depict an external top view, front view, and side view, respectively, of the embodiment depicted in FIG. 1A. Attention is drawn to the embodiment shown in FIG. 1B that clearly depicts all four flanges 24*a*, 24*b*, 32*a*, and 32*b*, and a plurality of attachment points, which can be used for securing each flange to a respective angled surface 20*a*, 20*b*, 30*a*, 30*b*. In addition and as shown in FIG. 1B, the plurality of attachment points for each of the four flanges 24*a*, 24*b*, 32*a*, and 32*b* can be used for securing a respective peripheral injection port 22*a*, 22*b*, 32*a*, 32*b*. Attention is also drawn to FIGS. 1C and 1D which show the depicted embodiment having approximately 50% smaller depth than width, although as with FIG. 1A, it can be appreciated that these dimensions will vary according to the requirements of the injection port configuration of each particular wellhead 10. FIGS. 1C and 1D depict front and side views, respectively, of the wellhead 10 embodiment of FIG. 1A. FIG. 1C shows flanges 24*a*, 24*b*, and 34*a* comprising attachment points for securing respective peripheral injection ports 22*a*, 22*b*, and 32*a*. FIG. 1D shows flanges 24*a*, 34*a* and 34*b* comprising attachment points for securing respective peripheral injection ports 22*a*, 32*a* and 32*b*. FIGS. 1C and 1D also depict the central bore 12 of the wellhead 10, which can be fastened by a flange 14, and the embodiment shown in these Figures includes a generic tubular 11 through which wireline operations can be conducted and various tools can be passed.

Figure 2A:
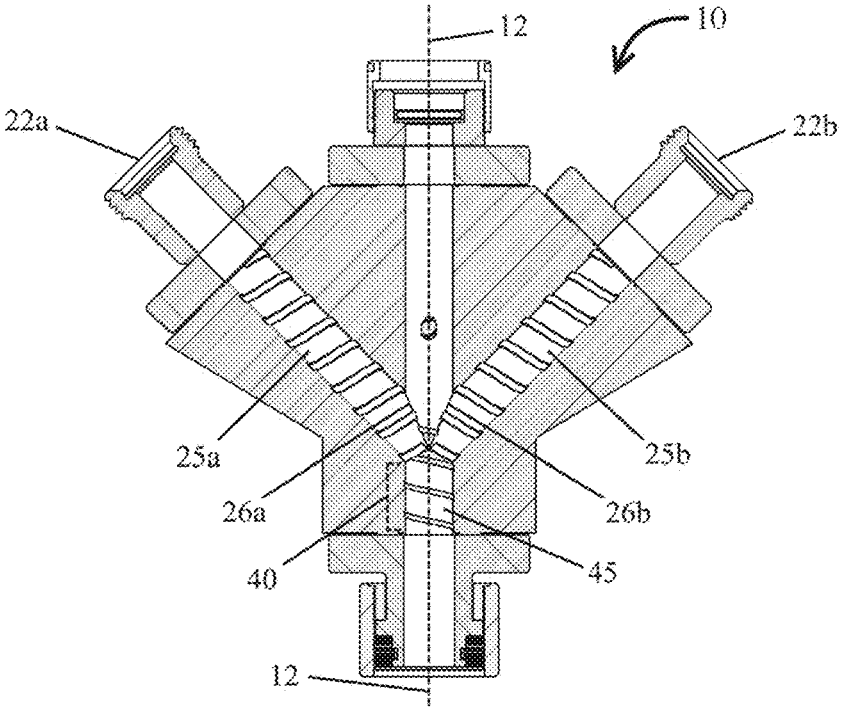
FIG. 2A depicts a cross-sectional front view of an embodiment of the wellhead.
Figure 2B:
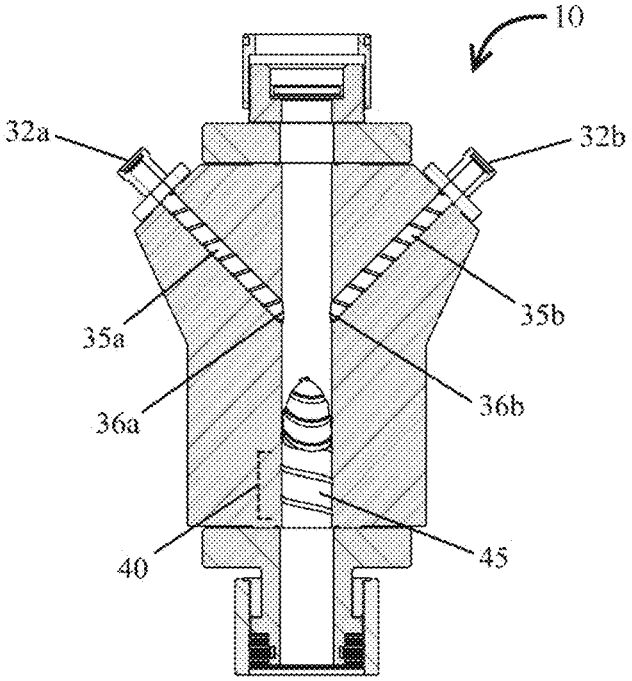
FIG. 2B depicts a cross-sectional side view of an embodiment of the wellhead.

Turning now to FIGS. 2A and 2B, a detailed cross-section of the embodiment as depicted in front view 1C and side view 1D, respectively, is presented in further detail. FIG. 2A depicts the primary peripheral injection ports 22*a* and 22*b* in fluid communication with internal bores 25*a*, 25*b*. Attention is drawn to the rifled internal bores 25*a*, 25*b*, depicted here as a spiral rib pattern which protrudes slightly outward (i.e. creating a groove) within the space of rifled internal bores 25*a*, 25*b*. It should be noted that any method of creating a rifled spiral pattern is within the scope of this embodiment; the spiral pattern may be a concave groove machined into the bore, or a convex protrusion created by a spiral insert attached to the bore surface (or alternatively, an insert may define a concave groove).

When fluid is injected through either of the primary peripheral injection ports 22*a*, 22*b*, the rifled internal bores 25*a*, 25*b* can introduce a centrifugal force into the fluid flow, thus causing the fluid to flow in a circular or helical pattern as it descends through the rifled internal bores 25*a*, 25*b* into a mixing chamber 40 at exit orifices 26*a*, 26*b*. The mixing chamber 40, as shown in FIG. 2A, can comprise a rifled internal bore 45.

FIG. 2B depicts a similar arrangement for the secondary peripheral injection ports 32*a*, 32*b*, which are shown in fluid communication with internal bores 35*a*, 35*b*, having a similar rifled groove pattern to internal bores 25*a*, 25*b*. Similar to FIG. 2A, the rifled internal bores 35*a*, 35*b* can introduce a centrifugal force into the fluid flow, thus causing the fluid to flow in a circular or helical pattern as it descends through the rifled internal bores 35*a*, 35*b*, and also leading to the mixing chamber 40 through respective exit orifices 36*a*, 36*b*. While the rifled internal bores 25*a*, 25*b* are shown, in FIG. 2A, having similar dimensions to the central bore 12 of wellhead 10 and matched to the primary peripheral injection ports 22*a* and 22*b*, the rifled internal bores 35*a*, 35*b*, in FIG. 2B, as shown having smaller dimensions to match the secondary peripheral injection ports 32*a*, 32*b*.

As with the ports, it can be appreciated that alternate embodiments of the invention may comprise any combination of rifled internal bores, including bores of equal size, or bores having four different sizes. Additionally, it can also be appreciated that some embodiments of the invention may feature un-rifled bore(s), as already known in the art, alongside rifled bores to give operators the option of not utilizing the circular or helical flow pattern introduced by the rifling.

Mixing chamber 40, as depicted in FIGS. 2A and 2B, is a component of the wellhead 10 located internal to the surfaces and beneath central bore 12. Mixing chamber 40 is depicted here as substantially uniform with central bore 12; this confers several advantages including the ability to insert wellbore tools requiring (or preferring) a constant internal diameter, and also simplifies the control of fluid flow through the wellhead 10.

Mixing chamber 40 is demarcated by a number of exit orifices 26*a*, 26*b*, 36*a*, 36*b* leading from rifled internal bores 25*a*, 25*b*, 35*a*, 35*b*, respectively, as described above. Mixing chamber 40 can also feature a rifled internal bore 45, which can act to continue the circular or helical flow pattern of the fluid as it descends into the wellbore (not shown), beneath wellbore 10 and continuous with the central bore 12.

In an embodiment, the wellhead 10 is utilized to allow the mixing of fluid (gas or liquid) in the mixing chamber 40 via injection ports 22*a*, 22*b*, 32*a*, 32*b* at the same time as conducting wireline work (including slick-line, braided-line, or electric-line wireline) or remedial work with pipes (coil tubing or jointed pipe). These mixes may include one or more of cement, chemicals, powder, ash, beads, pellets, freshwater, seawater, or brine.

Various embodiments, usable within the scope of the present disclosure, have been described with emphasis and these embodiments can be practiced separately or in various combinations thereof. In addition, it should be understood that within the scope of the appended claims, the present invention can be practiced other than as specifically described herein.

The invention claimed is:

1. A wellhead comprising:

a body;

a central bore therethrough;

a plurality of peripheral bores intersecting with the central bore, wherein the plurality of peripheral bores each comprise an injection port and a rifled internal surface; and a mixing chamber located within the central bore below the intersections between the plurality of peripheral bores and the central bore, wherein the rifled internal surfaces of the plurality of peripheral bores act to guide fluids injected into the wellhead into a helical flow pattern prior to entering the central bore.

2. The wellhead of claim 1, wherein the mixing chamber further comprises an additional rifled internal surface.

3. The wellhead of claim 1, wherein the plurality of peripheral bores comprise a first plurality of peripheral bores with a first diameter and a second plurality of peripheral bores with a second diameter.

4. The wellhead of claim 3, wherein the first diameter is greater than the second diameter.

5. The wellhead of claim 4, wherein the intersections between the first plurality of peripheral bores and the central bore define a first plurality of exit orifices, wherein the intersections between the second plurality of peripheral bores and the central bore define a second plurality of exit orifices, and wherein the first plurality of exit orifices is located beneath the second plurality of exit orifices.

6. The wellhead of claim 1, further comprising a plurality of angled surfaces, wherein each angled surface of the plurality of angled surfaces corresponds to each injection port of the plurality of peripheral bores.

7. The wellhead of claim 6, further comprising a plurality of flanges, each flange of the plurality of flanges operatively connecting each injection port with the plurality of peripheral bores.

8. The wellhead of claim 1, wherein the rifled internal surfaces comprise a concave groove machined therein, the concave groove defining a helical pattern throughout the length of the respective peripheral bores.

9. The wellhead of claim 1, wherein the rifled internal surfaces comprise a convex groove defined by a wellbore insert, the convex groove defining a helical pattern throughout the length of the respective peripheral bores.

10. The wellhead of claim 2, wherein the mixing chamber and the central bore comprise a single diameter.

11. The wellhead of claim 1, wherein the body comprises a width and a depth, wherein the depth of the body is less than the width of the body.

* * * * *